US008864628B2

(12) United States Patent
Boyette et al.

(10) Patent No.: US 8,864,628 B2
(45) Date of Patent: Oct. 21, 2014

(54) REHABILITATION DEVICE AND METHOD

(71) Applicants: Robert B. Boyette, Wall Township, NJ (US); Mark E. Kolb, Bridgewater, NJ (US)

(72) Inventors: Robert B. Boyette, Wall Township, NJ (US); Mark E. Kolb, Bridgewater, NJ (US)

( * ) Notice: Subject to any disclaimer, the term of this patent is extended or adjusted under 35 U.S.C. 154(b) by 0 days.

(21) Appl. No.: 14/197,386

(22) Filed: Mar. 5, 2014

(65) Prior Publication Data

US 2014/0274565 A1 Sep. 18, 2014

Related U.S. Application Data

(60) Provisional application No. 61/776,904, filed on Mar. 12, 2013.

(51) Int. Cl.
*A63B 24/00* (2006.01)

(52) U.S. Cl.
USPC ..... 482/6; 482/1; 482/8; 482/901

(58) Field of Classification Search
USPC ..... 482/1–9, 51, 57, 900–902; 74/594.1–594.6; 280/252–261
See application file for complete search history.

(56) References Cited

U.S. PATENT DOCUMENTS

| | | | | |
|---|---|---|---|---|
| 2,602,677 | A | 7/1952 | Connolly | |
| 3,888,136 | A | 6/1975 | Lapeyre | |
| 3,922,929 | A | 12/1975 | Marchello | |
| 3,964,742 | A | 6/1976 | Carnielli | |
| 4,863,157 | A | 9/1989 | Mendel et al. | |
| 4,915,374 | A | 4/1990 | Watkins | |
| 5,163,886 | A | 11/1992 | Seol | |
| 5,601,515 | A | 2/1997 | Matsumoto | |
| 5,853,353 | A | 12/1998 | Blumel | |
| 6,589,139 | B1 | 7/2003 | Butterworth | |
| 7,594,879 | B2 | 9/2009 | Johnson | |
| 7,727,125 | B2 | 6/2010 | Day | |
| 7,780,583 | B2 | 8/2010 | Brown | |
| 7,942,786 | B2 | 5/2011 | Rolli | |
| 7,976,433 | B2 | 7/2011 | Kenyon | |
| 8,025,607 | B2 | 9/2011 | Ranky et al. | |
| 2002/0033070 | A1 * | 3/2002 | Harrington | 74/594.1 |
| 2003/0092534 | A1 | 5/2003 | Forcillo | |
| 2003/0092536 | A1 * | 5/2003 | Romanelli et al. | 482/60 |

(Continued)

FOREIGN PATENT DOCUMENTS

DE 102008028377 A1 12/2009

*Primary Examiner* — Glenn Richman
(74) *Attorney, Agent, or Firm* — Lowenstein Sandler LLP

(57) ABSTRACT

A device for joint rehabilitation after injury or surgery and a method of use are described and taught. The device automatically senses and manipulates performance parameters to optimize the rehabilitation process in response to user performance. In particular, device sets the pedal throw and other variables automatically to be in an optimum range for the patient based on the respective patient data. A motor resistance unit allows for the user to experience variable resistances while using the device. This not only increases the patient's range of motion but also strengthens and increases muscle tone. In order to use the device, the patient or user simply inputs preliminary parameters and the on-board computer then calculates a rehabilitation plan, and monitors patient performance and adapts to changes. The central data server permit central storage of all data associated with usage of the rehab devices and is fully HIPAA compliant.

31 Claims, 12 Drawing Sheets

(56) References Cited

U.S. PATENT DOCUMENTS

| | | | | |
|---|---|---|---|---|
| 2004/0053750 | A1 | 3/2004 | Forcillo | |
| 2005/0020411 | A1 | 1/2005 | Andrews | |
| 2009/0151509 | A1 * | 6/2009 | French | 74/594.1 |
| 2009/0211395 | A1 | 8/2009 | Mul'e | |
| 2011/0174096 | A1 | 7/2011 | Florschutz | |
| 2012/0166105 | A1 | 6/2012 | Biermann et al. | |
| 2012/0167709 | A1 | 7/2012 | Chen et al. | |
| 2012/0329611 | A1 | 12/2012 | Bouchard et al. | |

* cited by examiner

REHABILITATION DEVICE AND METHOD

CLAIM OF PRIORITY

This application claims priority to U.S. Provisional Application 61/776,904 filed on Mar. 12, 2013 the contents of which are herein incorporated by reference in their entirety.

FIELD OF THE INVENTION

The field of the invention relates to rehabilitation devices, namely devices that help people recover from joint injuries, surgeries or the like. In particular, to equipment with pedals or linear sleds, which are used by therapists, to help increase flexibility, strength, and muscle tone by repeatedly taking the injured appendage through a range of motion.

BACKGROUND OF THE INVENTION

Bicycles were first introduced in early-mid $19^{th}$ century Europe. Today, there are twice as many bicycles as there are cars. Bicycles are human-powered modes of transportation typically consisting of a frame, two wheels, seat, handlebars, pedals, gears, and a chain. By using the pedals, one can propel the bicycle forward and can control the speed at which they move by varying their pedal speed along with changing the associated gears on the bicycle. People can ride bicycles for pleasure or for competitive purposes and the style of bicycle often reflects the intended use. The advent of the bicycle has led to a number of related technologies including stationary bicycles.

Stationary bicycles allow an individual to remain in place as they pedal. Stationary bicycles are typically used in gyms or homes by individuals when the weather is not conducive for riding outside or for training/workout purposes. Stationary bicycles are also used by physical therapist/rehabilitation technicians for rehabilitation purposes. They allow an individual rehabbing to workout various muscles and joints without risking a fall. Additionally, an individual can rehab in such a way as to remove the weight from specific load bearing joints and muscles that may not be ready for full weight bearing exercises.

After an injury or surgery to the hip or knee, one of the first priorities is to begin to restore the range of motion to the affected joint. Typical range of motion of the knee can be measured in knee flexion and knee extension by a device called a goniometer. A goniometer has two pieces that are connected by a central hinge. By lining up each of the pieces along a specific joint area and having the individual move that joint, a value in degrees (i.e. 120°) can be observed and recorded. Knee flexion is when an individual lies on their back and draws their heel to the back of their leg. Typical values for knee flexion are approximately 130-150°. Knee extension is the amount to which a person can straighten their leg. Typical values for knee extension are 0-10°. The same type of methodology can be applied to the hip as well. Hip flexion is typically measured at about 125°, hip extension approximately 10-15°, hip rotation 30-40°, abduction 40°, and adduction approximately 15-20°. These values represent what is typical in a healthy individual and may have some variance from person to person. After an injury or surgery, these values can be minimal as injury or surgery often results in a substantial loss in range of motion.

Stationary bicycles can be problematic for these individuals since they have such a limited range of motion and/or a decreased amount of strength or muscle tone. The pedals are fixed and create a uniform circumference when rotated. Since these individuals may not be able to fully achieve this rotation they must begin to pedal and then change direction when they have reached their range of motions limits. The process then repeats as they continually pedal and reverse their pedaling direction. Additionally, since the pedals are in a fixed location, once an individual has begun to regain their range of motion there is a limit to how far they are able to progress. The circumference created by the rotating pedals is sized to accommodate the "average" sized person, however, a rehab patient may need a larger or smaller circumference. The fixed pedal throw does not allow multiple users to achieve the same benefits. One user may have shorter legs and/or a more severe injury and the pedal may be too long to rotate comfortably, whereas another individual may be taller or less injured and need a longer pedal throw to achieve the required amount of flexion for optimal recovery. Additionally, stationary bicycles require manual set up and control from the user or a physical therapist/rehabilitation technician, to control programming and other options.

Reviewing Related Technology:

U.S. Pat. No. 7,594,879 teaches a manual rotary rehabilitation apparatus is presented for rehabilitation of a person's extremity, including the joints and assorted muscles, tendons, ligaments, that can be tailored to the person's needs based upon their physical size, type of injury, and plan for recovery. The apparatus facilitates the adjustment of the range of motion of the user's extremity in a cycling action by offsetting a moveable lever from a fixed lever at a plurality of angles. As the user's extremity moves in a circular path, the extremity engages in extension and flexion to cause movements in the articulations formed at the user's joints.

U.S. Pat. No. 6,341,946 teaches an apparatus for gearless shifting, includes at least one crank, and an arm assembly, coupled to the at least one crank, for telescoping to adjust a length of the at least one crank, to selectively and controllably adjust a stroke length of the at least one crank. A pump is also provided including a variable-stroke length apparatus.

U.S. Patent Application 2012/0167709 teaches a crank system mounted to a drive sprocket of a bicycle includes a crank arm secured to the drive sprocket and disposed at both sides thereof, the crank arm having two bent ends; and two telescopic assemblies each comprising a bar having one end fixedly secured to either end of the crank arm, the bar having a cross section of polygon, the bar including a plurality of longitudinal notches, a sliding tube slidably put on the bar, the sliding tube including a surface opening communicating with the bar, and a pivotal lock member in the surface opening, the lock member being adapted to either dispose in one of the notches in a locked position of the telescopic assembly or clear the notch in a unlocked position of the telescopic assembly. This length adjustable bicycle crank system can save force when pedaling.

U.S. Patent Application 2012/0329611 teaches a motorized rehabilitation apparatus and method for disabled, impaired or injured individuals, which trains a proper gait, increases blood flow, relieves stress, and reconditions lower body muscles and joints. The device comprises a powered stationary bicycle having a seat, handle grips, and rotating foot pedals that receive motive input from an electric motor and user input. The device further includes a pair of thigh braces that are connected together between the user's thighs via a hingeable link and chain that controls and trains an individual's limbs through the pedal rotation. The disclosed method further combines the bicycle device for rehabilitation in conjunction with visual stimuli in the way of a three dimensional television display that stimulates endorphins, relieves mental stress and allows the motive input from the bicycle and mild user input to exercise the limbs of a user without focusing on the rehabilitation activity.

Various devices are known in the art. However, their structure and means of operation are substantially different from the present disclosure. The other inventions fail to solve all the problems taught by the present disclosure. The current invention provides for a dynamic pedal throw that is automatically changed in response to the user's ability and/or performance. The microprocessor interprets the inputs from the user and converts those to a custom rehabilitation program. At least one embodiment of this invention is presented in the drawings below and will be described in more detail herein.

SUMMARY OF THE INVENTION

The current disclosure is generally related to an automated device which evaluates a rehabilitation patient's current condition, designs a therapy program based on the patient's parameters and instructs the patient during rehabilitation, and monitors the patient's progress, along with adjusting the equipment continuously in real time. A rehabilitation device is described and taught having automated, multi-positional elements having a frame with at least one cross bar and a base member, the frame having a first vertical support for a seat and an articulating second vertical support having a pivot joint and supporting a set of handlebars, a horizontal support attached to the first vertical support, and a pedal assembly; a motor resistance unit coupled to the pedal assembly by a coupling mechanism; wherein there are at least two actuators on the pedal assembly, the pedal assembly comprising a crank axle and a crank arm extending from each end of the crank axle wherein the at least two actuators are on each of the crank arms thereby altering the circumferential diameter of the pedal assembly; wherein there is a plurality of linear actuators for eliciting movement of the seat and the second vertical support.

In this embodiment, the rehabilitation device has an actuator attached to the second vertical support which enables the back and forth movement of the second vertical support relative to the first vertical support. This changes the hip and knee angle of a user allowing them to increase their range of motion and build strength. This is further accomplished through the motor resistance unit. The motor resistance unit can either drive or provide a simulated resistance to the pedal assembly. The key to this is the motor resistance unit automatically adjusts the movement of the pedal assembly based on the microcontroller's assessment of the user's performance. This is done by collecting a wide variety of data from the sensors on board the rehabilitation device. The data from these sensors is interpreted by the microprocessor and adjustments are accordingly made. This is achieved through the implementation of the Analysis, Control, and Reporting Software (ACRS) embedded in the microprocessor. This software may exist in the rehab unit, an off site central data server, or both. Additionally, this software may be implemented on the form of mobile applications (apps) on smartphones, tablets, and the like. In order to select a program or input data, the rehabilitation device further has a programmable touchscreen. Additionally, the data can be accessed from the programmable touchscreen. The data may also be transmitted wired or wirelessly to third parties. Such communications, including those made through the ACRS, are encrypted and meet all HIPAA requirements.

The rehabilitation device further has a plurality of sensors and a microprocessor. The sensors monitor input variables such as torque and rotational speed. The microprocessor records the initial and final parameters as well as logs the performance data. This log creates a viewable database that can be transmitted to third parties through wired or wireless means. The database includes such information as the initial and final angle of flex, the rate of improvement, derivative of improvement, duration of session, and number of repetitions. The motor resistance unit is coupled to the pedals by a coupling mechanism such as a chain or band or the like. The motor resistance unit can help to drive the pedals or provide resistance while a user is pedaling. The device further has a number of linear actuators which permit the seat height to change. In some instances, the handlebars may bear the same functionality.

In another embodiment there is a portable rehabilitation unit with a motor resistance unit having a housing; a plurality of sensors and a microprocessor contained within the housing; a pedal assembly operably connected to the motor resistance unit, wherein the motor resistance unit automatically adjusts the rotational speed or simulated resistance, wherein the pedal assembly comprises a crank axle and a crank arm extending from each end of the crank axle wherein the at least two actuators are on each of the crank arms thereby altering the circumferential diameter of the pedal assembly; and a coupling mechanism that operably connects the pedal assembly to the motor resistance unit.

The portable rehabilitation unit operates in substantially the same fashion and uses the same algorithms as the previously described embodiment. As such, the microprocessor/display unit 20 automatically sets and manipulates all device adjustments to optimal values for the specific patient. Additionally, this unit permits for bidirectional communication. The unit can communicate data in real time to a remote professional and permits the remote professional to modify the parameters of the unit in real time. A remote professional may be a physical therapist/rehabilitation technician or a physician.

In another aspect of the invention, a method of optimizing a recovery process using a rehabilitation device, as described above, having the steps of: setting a pedal diameter to the minimum value permitted by the rehabilitation device for a first time user, wherein the pedal diameter is set by the control processor; allowing a user to begin pedaling while a microprocessor monitors input values such as crank speed; increasing the pedal diameter automatically in response to the microprocessor monitoring the input values; reducing the pedal diameter automatically once the input values have reached a particular predetermined threshold; holding the pedal diameter at a consistent value slightly below the predetermined threshold; increasing the pedal diameter automatically after a predetermined time of consistent output values; and repeating the first increasing to second increasing steps until the preset time or number of cycles is achieved.

In this method, the consistency of the crank speed (or the consistency of the applied torque) is a determinative factor in the change in pedal diameter. A repeatedly inconsistent pedal speed at a specific position in the pedal travel results in a decrease in pedal diameter, and a consistent pedal speed for a predetermined timeframe results in a slight increase in pedal diameter. The method may further have the step of recording the output values in relation to time. Any of the recorded values are stored on a storage medium.

It is an object of the present invention to provide a rehabilitation device specifically designed for knee/hip rehabilitation following surgery or injury.

It is an object of the present invention to provide a rehabilitation device with an automated adjustable pedal throw.

It is an object of the present invention to provide a rehabilitation device that has a motorized, automatically adjustable seat height.

It is an object of the present invention to provide a rehabilitation device that has motorized, automatically adjustable handlebars.

It is an object of the present invention to provide a rehabilitation device that automatically adjusts the pedal throw, handlebars, and seat based on the progress or lack thereof directed to a specific candidate during a rehabilitation workout.

It is yet another object of the present invention to provide a rehabilitation system that automatically sets the system parameters to optimal values for each specific user and continuously monitors the patient's progress in real time and makes adjustments to the system parameters as the patient's physical condition changes, without any human intervention from the user or professional personnel.

It is an object of the present invention to provide a rehabilitation device that records output values from multiple sessions for each specific user.

It is an object of the present invention to provide a rehabilitation device that can be used by people of differing heights and of differing degrees of joint mobility.

It is an object of the present invention to provide a rehabilitation device that reduces physical therapist/rehabilitation technician time and cost due to a fully automatic operation.

DETAILED DESCRIPTION OF THE INVENTION

Figure 1:
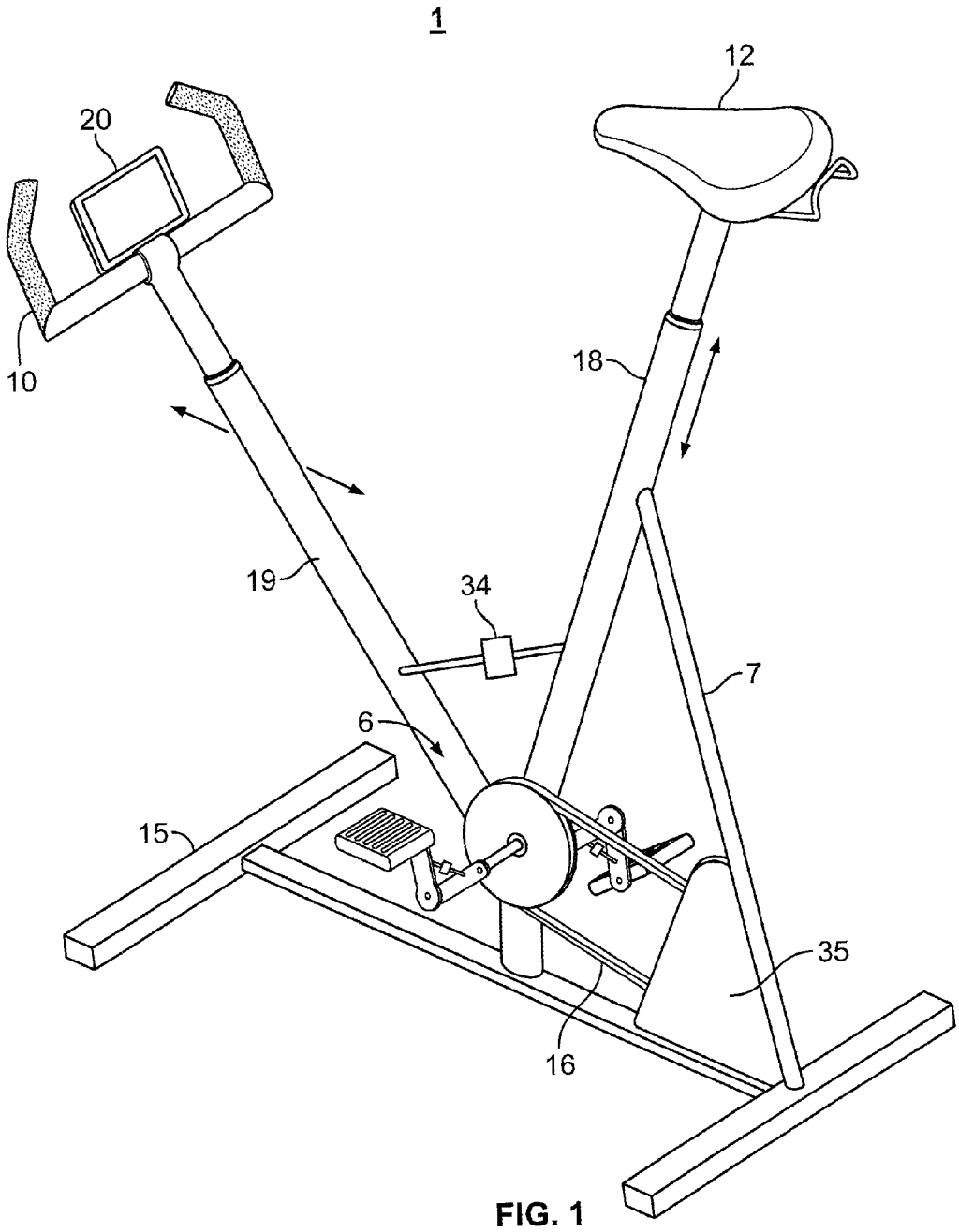
FIG. 1 is a perspective view of a first embodiment of the present invention.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Referring to FIG. 1, there is a first embodiment of the present invention. The rehabilitation device 1 has a first vertical support 19 and a second vertical support 18. The second vertical support 18 is further supported by a rear support 7. The first vertical support 19 has a pivoting joint 6. The pivoting joint 6 permits articulation of the first vertical support 19. This motion can draw the first vertical support 19 either towards or away from the user while positioned on the rehabilitation device 1. The movement of the first vertical support 19 is controlled by a linear actuator 34 that extends between and connects the first vertical support 19 and second vertical support 18. By changing the position of the first vertical support 19, the hip and knee joint angles of the user can be manipulated as well. The rehabilitation device 1 has a motor/resistance unit (MRU) 35. This unit 35 can perform a number of functions including providing a powered drive mechanism for rotating the pedals. This is particularly useful when the rehabilitation device 1 is being used by an individual with extremely limited use of their legs. Additionally, the motor resistance unit 35 can create an artificial resistance. This further adds to the rehabilitation device 1 as a way to increase muscle tone and strength.

Additionally, the rehabilitation device 1 shall have a microprocessor/display unit 20 which has been programmed with algorithms that control the rehabilitation process. These are manifested in the Analysis, Control, and Reporting Software (ACRS). This software enables the rehab units to communicate with an offsite central data server. It also provides for communications to originate from the server and be displayed on the microprocessor/display unit 20. This can, in turn, provide various functionality including downloading patient configuration parameters, and sending patient data to the database for instant analysis at third party locations such a physical therapist/rehabilitation or physician's office. The central data server provides cloud based storage and access to all data and communicates with other devices and programs with access to the database. In turn, the patients can access the same through a number of different devices. This provides for a secure login/logout for the patients, as well as the ability to monitor their data and progress against benchmarks and others. Additionally, functionality is included for the sharing of progress through social media. From the clinician side, the functionality is substantially similar, however, it also provides for the ability to customize the microprocessor/display unit 20 operation for each individual patient through various control parameters. Equally as important, the software provides administrative protocols for manipulation of certain data or certain algorithms.

The microprocessor/display unit 20 has a touch screen display used for data entry and performance readout. The microprocessor/display unit 20 may be attached in a variety of areas on the rehabilitation device 1 in order to best give the user access to the settings. In some cases, it may not be desirable to have an attached display, in which case the data is simply sent to a remote display by wired or wireless protocols. This would prevent user manipulation and give a greater breadth of control to the rehabilitation technician. If the microprocessor/display unit 20 is wireless it may operate off any number of protocols in the art including but not limited to Wi-Fi, ANT, ZigBee, Bluetooth®, and the like.

The microprocessor/display unit 20 may have either resistive or capacitive touch capabilities. Each has its unique advantages and may be employed to best suit the needs of the receiving entity. Resistive touchscreens are comprised of several layers, with the top two layers separated by a minute distance. This technology has a low associated cost and is highly resistant to contaminants and liquids. Additionally, the resistive touchscreens still function when a user is wearing a glove or similar skin covering structure. Thus, it has found a practical purpose in many hospital settings. Capacitive resistance typically employs a glass layer coated with a transparent conductor. These screens see a much higher associated cost and cannot be used if an individual is wearing, for example, latex gloves. In that case, the user would need a particular type of stylus in order to interact with the screen.

From the main interface on the microprocessor/display unit 20, the necessary user profile can be selected. The microprocessor/display unit 20 creates a daily workout program based on a user's previous data and the rehab protocol in order to best optimize their workout and recovery. Here, the microprocessor/display unit 20 would automatically make the settings necessary when a previous user identity is selected. This automatic manipulation of the settings and device parameters continues throughout the workout.

Figure 2:
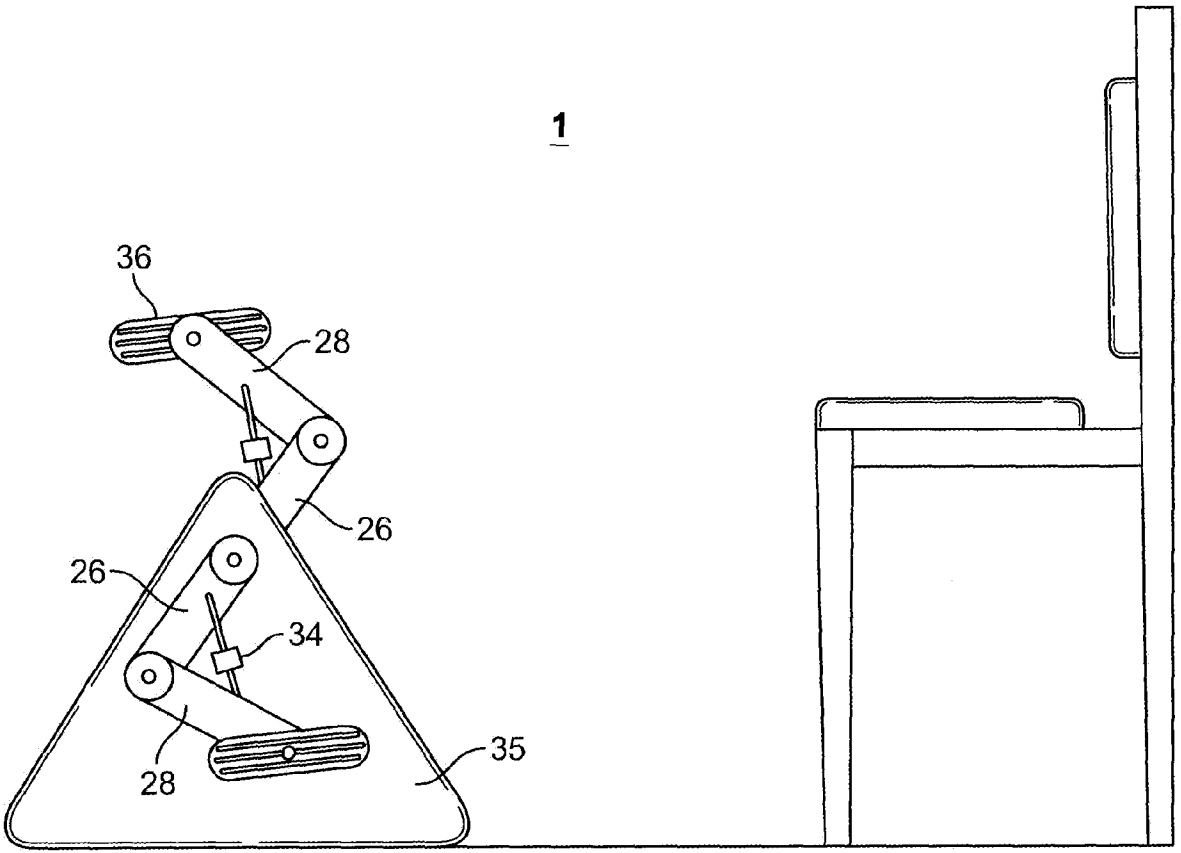
FIG. 2 is a side view of a portable embodiment of the present invention.

FIG. 2 is a side view of a portable embodiment of the present invention. The rehabilitation device 1 in this embodiment is a mini rehab bicycle. The unit comprises primarily a motor resistance unit 35 having a housing with the pedal assembly 24 extending therefrom. The pedal assembly 24 is further described in FIG. 4. The rehabilitation device 1 performs substantially the same general function and contains the same algorithms as described in FIG. 1, however, the portable nature of the device 1 allows it to be used in the home or office and taken with the user from place to place. An individual can simply sit in a chair and pedal and the program will run and adjust parameters according to user progress. This means that the device 1 reacts and adjusts to the user's performance. This provides a distinct advantage by consistently maximizing the patient's recovery rate. The coupling mechanism 16 is maintained internally. The base of the housing of the motor resistance unit 35 may have a no-slip surface applied to it to prevent slippage while in use, and may have an extension which fits under the chair legs to further hold it in place. This device 1 further provides for bidirectional communication. This enables the device 1 to be monitored in real time by a local or remote health professional (i.e. physical therapist/rehabilitation technician, physician, etc.). The professional can send messages to the patient of modify the physical parameters based on the data send to the professional.

Figure 3:
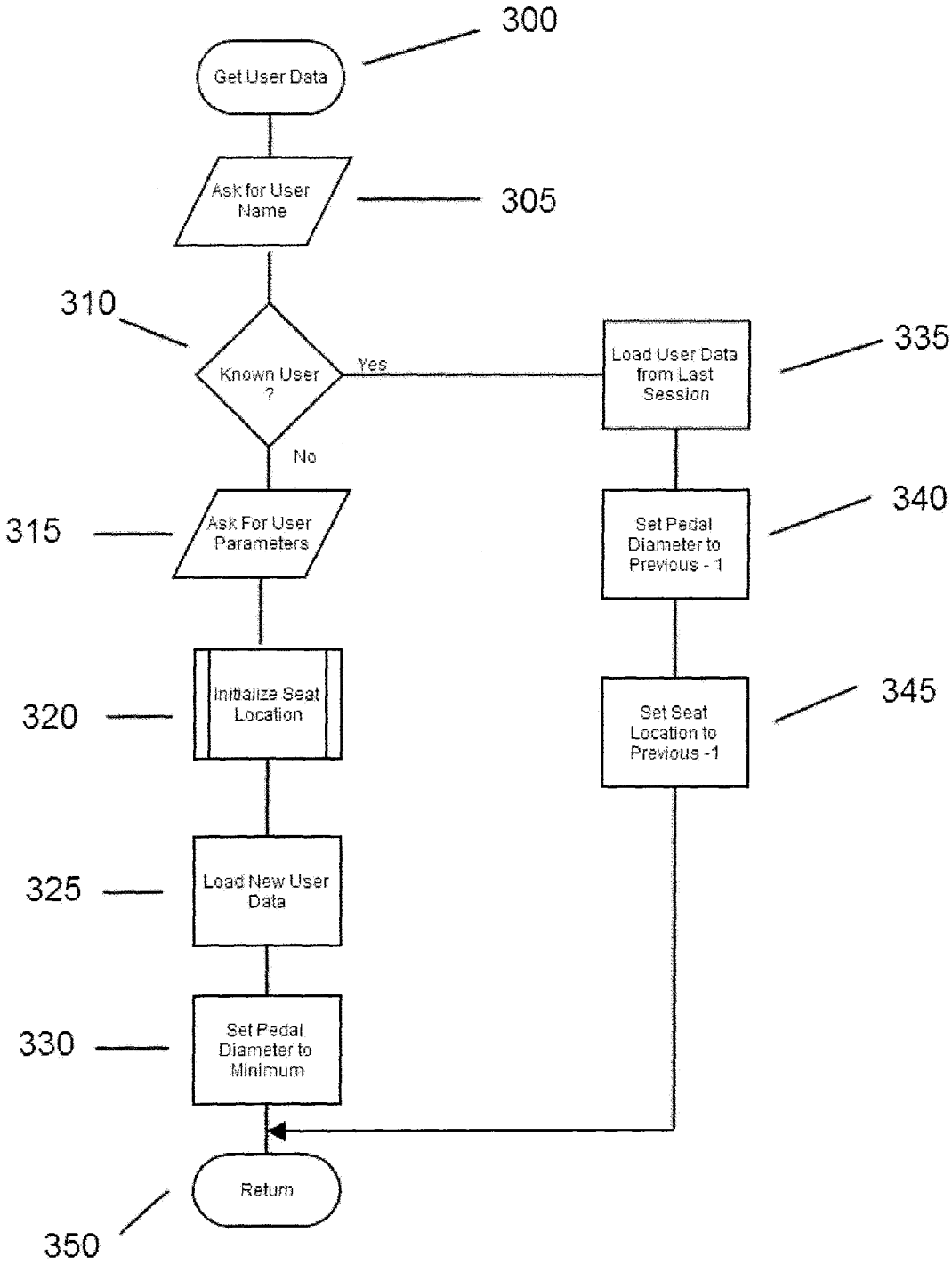
FIG. 3 is a flowchart illustrating an overview of usage of a preferred embodiment of the present invention.

In FIG. 3, there is an overview for initializing the settings of the rehabilitation device for a specific user in accordance with the present invention. When a user first gets on to the rehabilitation device 1 the microprocessor/display unit 20 will prompt them to identify themselves 300. Ideally, this is done by asking the user to input their name (first, middle, last, or any combination thereof) 305. Identification means may also include pin numbers, passwords, social security numbers (SSN), birthdates, or biometric readings such as fingerprints, iris scans, or the like. Based upon one of the prompts, the microprocessor/display unit 20 will load the last session date or start a new rehabilitation session 310. If the user is a known user then the microprocessor/display unit 20 will load the user's data from their previous session 335. If the individual is a new user, the microprocessor/display unit 20 will prompt the user to input new user parameters 315. These are parameters by which a profile can be constructed to keep track of and create workouts based on the information supplied by the user. These parameters may include sex, height, weight, age, body fat percentage, cholesterol levels, and the like. The microprocessor/display unit 20 will then be able to set the seat position 320 based on the pertinent data. The microprocessor/display unit 20 will load this new user data 325 and set the pedal diameter to the minimum 330 in order to begin rehabilitation. If the user was previously known then the pedal diameter and seat location will automatically adjust to the proper positions 340, 345 based on the results of their last session.

Figure 4:
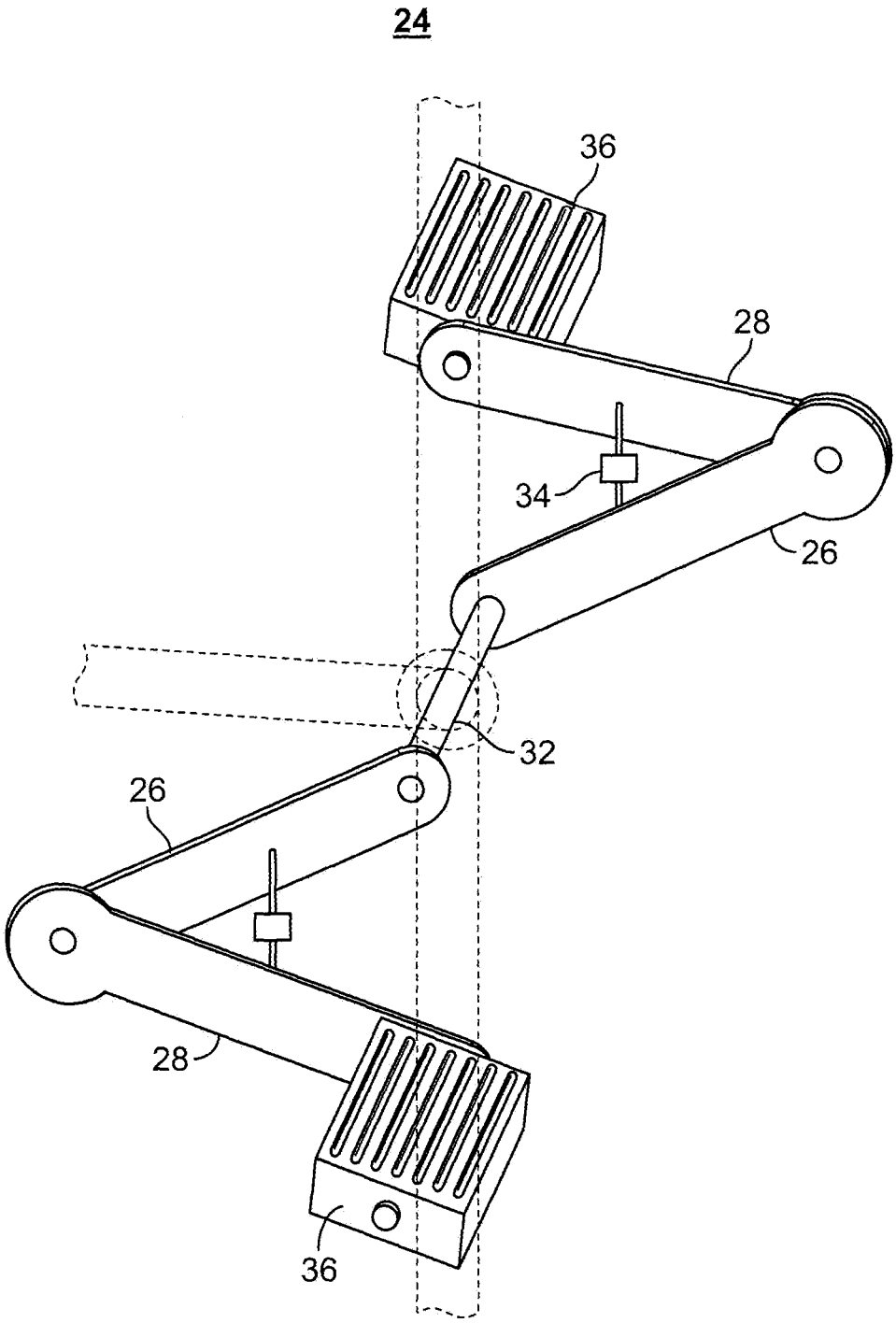
FIG. 4 is a perspective view of the pedal assembly.

The pedal assembly 24, FIG. 4, has two identical halves connected by the crank axle 32. Each half of the pedal assembly 24 has a pedal 36, upper crank arm 28, lower crank arm 26, a crank axle 32, and an actuator 34. The upper crank arm 28 is hingedly connected to the lower crank arm 26. The pedal 36 is coupled to the upper crank arm 28 on the end opposite the hinged connection. The crank axle 32 connects the two halves of the pedal assembly 24.

The pedal 36 is substantially rectangular in shape to provide a sufficient surface area for the foot to be placed, but may be square, triangular, etc. The pedal 36 can range from about 5 cm (2 inches) by about 10 cm (4 inches) to about 20 cm (8 inches) by about 40 cm (16 inches). Preferably, the pedal is about 10 cm (4 inches) by about 15 cm (6 inches). The pedal 36 is preferably plastic, but may be metal, wood, or the like. Additionally, the pedal may be smooth or have a ridged pattern for added traction. The pedal 36 is connected to the upper crank arm 28 by a screw. This allows for an unimpeded 360° rotation of the pedal 36. This permits the pedal 36 to change orientation as it passes through the rotation and to move with the flexion of the user's foot. The upper crank arm 28 is hingedly connected to the lower crank arm 26 by a bolt extending therethrough with a cap on each end preventing slippage of the hinge. Unlike the pedal 36, this hinge does not freely move as it is connected to an actuator 34. The crank arm may consist of a light weight metal such as aluminum, or may comprise a stronger, heavier metal such as steel to prevent damage to the device.

The actuator 34 is preferably a linear actuator with one end coupled to the upper crank arm 28 and the opposite end coupled to the lower crank arm 26. The actuator 34 can employ varying technology such as electromechanical or hydraulics. Here, it is preferable to use an electric actuator. The actuator 34 is coupled to the microprocessor and moves in real time as information is compiled and processed by the microprocessor. Depending on the information received by the microprocessor the actuator 34 can extend increasing the circumference of the pedal throw, or it can retract decreasing the circumference of the pedal throw. Alternatively, the pedal assembly 24 may have a disk whereby the pedal is attached and rotates. Rather than employing an actuator 34, the mechanism uses gears to adjust the circumferential path of the pedal arm and thereby the pedal itself.

Figure 5A:
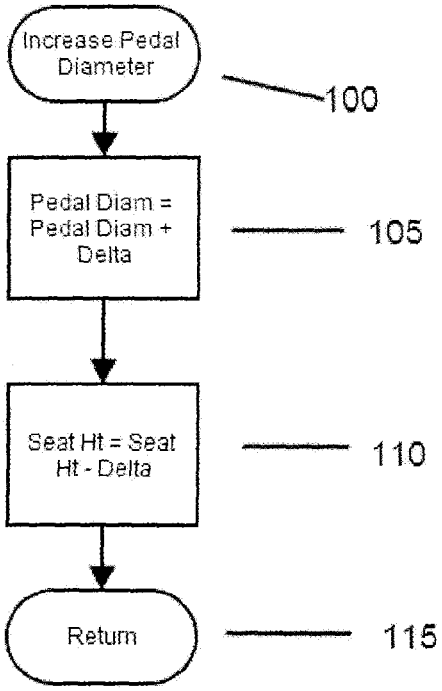
FIG. 5A is a flowchart illustrating the method of increase in pedal diameter.
Figure 5B:
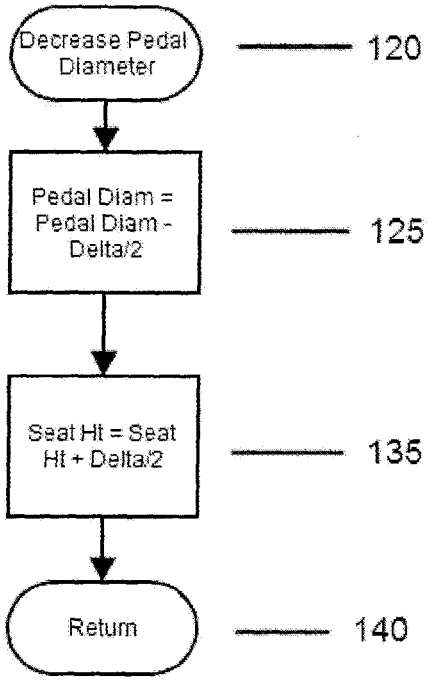
FIG. 5B is a flowchart illustrating the method of decrease in pedal diameter.

When changing the patient's range of motion by altering the pedal diameter the device 1 must maintain the correct distance from the seat to the low pedal position. FIG. 5 illustrates this process. The pedal diameter is determined by the distance between a crank axle and a pedal of a pedal assembly. The pedal assembly, as previously discussed, comprises a crank axle and an upper and lower crank arm extending from each end of the crank axle wherein the at least two actuators are on each of the crank arms thereby altering the circumferential diameter of the pedal assembly.

If the outputs from the rehabilitation device 1 are such that the pedal throw should be increased 100, then the pedal diameter calculated by the equation 105:

$$\text{pedal diameter}_f = \text{pedal diameter}_i + \Delta P$$

wherein the final pedal diameter (pedal diameter$_f$) is equal to the initial pedal diameter (pedal diameter$_i$) plus the change in diameter or delta (ΔP). In order to compensate for this change, the seat height must also be adjusted 110. The seat height adjustment is calculated by equation:

$$\text{seat height}_f = \text{seat height}_i - \Delta S$$

wherein the final seat height (seat height$_f$) is equal to the initial seat height (seat height$_i$) minus delta (ΔS). This enables the rehabilitation device 1 to keep the pedal and seat in proper spatial alignment with one another. This is most important in order to maintain the proper range of motion (ROM) for the rehabilitation strategy. Otherwise, when the pedal circumference shifts, the seat may be too low to allow the affected joint to travel through a fully cyclic motion.

In order to decrease pedal diameter 120, a different approach must be taken. The microprocessor/display unit 20 calculates a decrease in pedal circumference according to the equation 125:

$$\text{pedal diameter}_f = \text{pedal diameter}_i + (\Delta P/2)$$

wherein the final pedal diameter (pedal diameter$_f$) is equal to the initial pedal diameter (pedal diameter$_i$) minus the value of delta divided by two (ΔP/2). As with the methodology above, the seat height must also adjusted 135. The seat height is calculated by the equation:

$$\text{seat height}_f = \text{seat height}_i + (\Delta S/2)$$

wherein the final seat height (seat height$_f$) is equal to the initial seat height (seat height$_i$) plus the value of delta divided by two (ΔS/2). Again, this linked change in state necessary in order to maintain a proper range of motion throughout the adjustment and workout process. The system control processor can change the pedal resistance felt by the user. Thus, the resistance can be increased and then automatically reduced if the pedal rotation falls, or decreases, due to the increased resistive load. This protocol varies the load based on the desired goals of strength versus flexibility or in some instances both.

Figure 6:
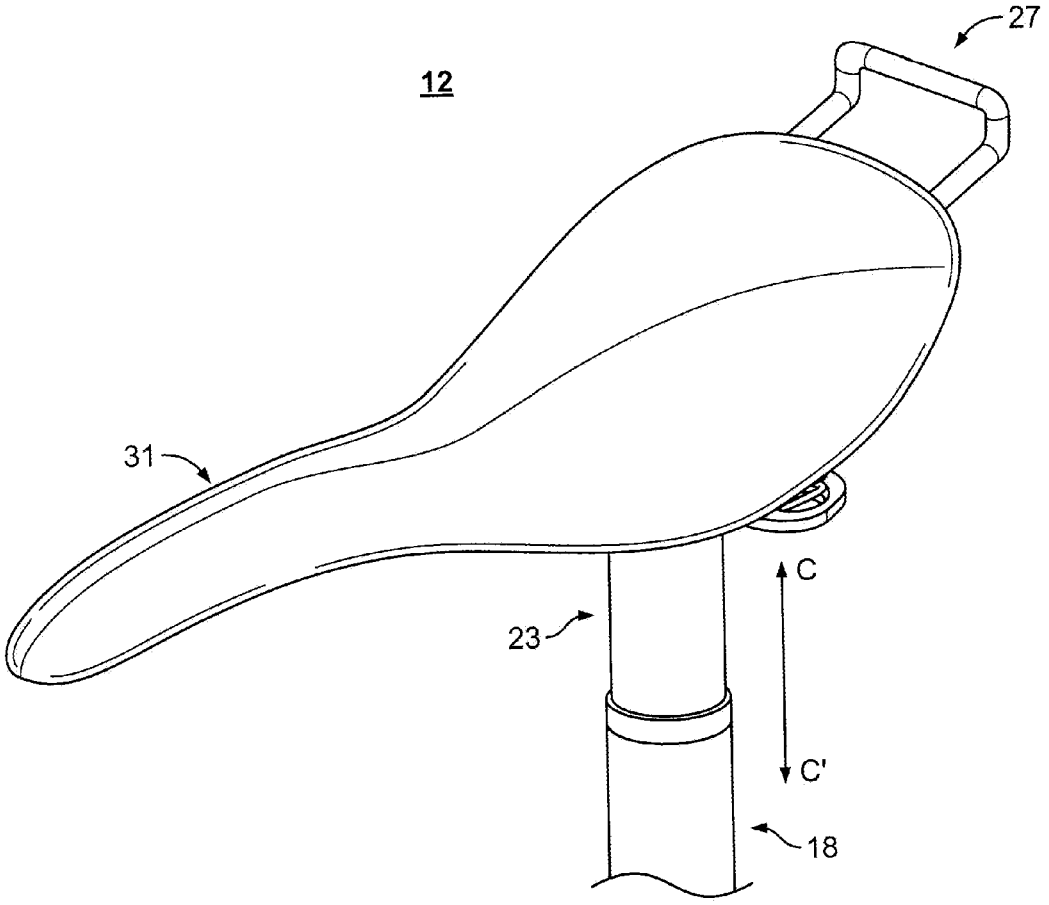
FIG. 6 is a perspective view of the seat assembly.

FIG. 6 is a perspective view of the seat assembly 12 of the rehabilitation device 1. The second vertical support 18 has a second telescoping support 23 extending from the top of the support 18. The telescoping support 23 is connected to an actuator 34 (not shown) within the second vertical support 18. The actuator 34 acts in accordance as previously described above. This, in turn, produces the vertical motion along path C-C' moving the seat 12 up and down. This is critical for achieving the proper range of motion in a rehabilitation patient. The seat height and the circumference of the pedal throw directly relate to the extent to which a knee or hip can be flexed or extended. Determining these values serves as the starting point and subsequent adjustment points for the physical rehabilitation. In addition to the height adjustment, the seat 12 may also slide forwards and backwards along adjustable rails 27. The seat 12 should have proper padding 31 and conform to the user. In some instances, the seat 12 may be detachable either by removing the seat 12 along with the telescoping support 23 or by simply removing the seat 12.

Figure 7:
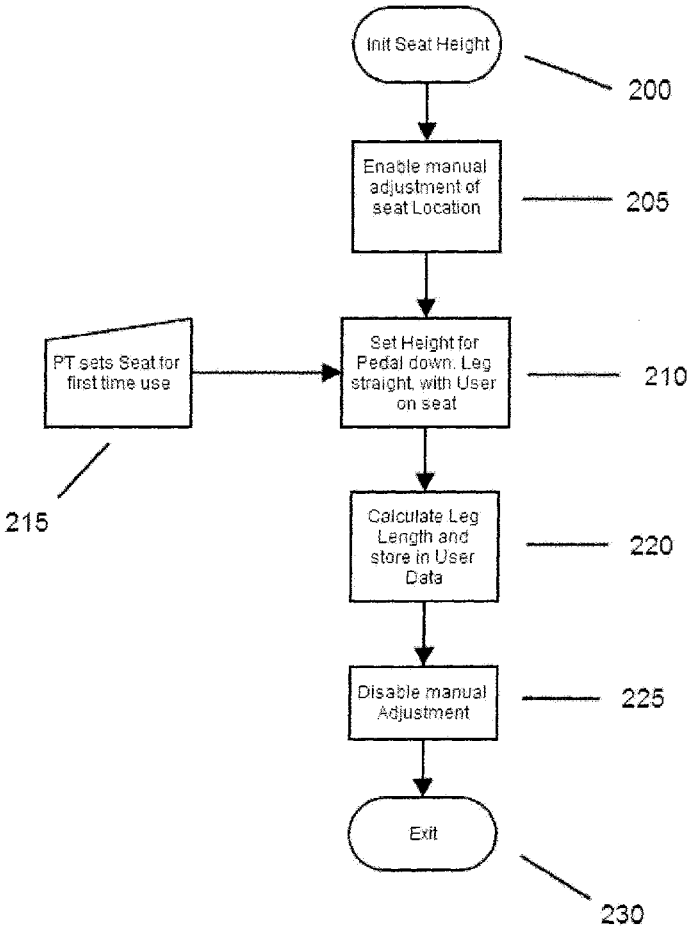
FIG. 7 is a flowchart illustrating the process of raising/lowering the seat.

In order to adjust the seat 12, the microprocessor/display unit 20 follows the protocol in FIG. 7. Based on the user's height and current range of motion of a particular joint or appendage an initial seat height can be selected 200. For a new user, this means that someone will either manually input a value for leg length or move the seat up/down until the position is correct. The initial process provides for the manual adjustment of the seat height 205. In order to begin at the proper height, the legs of the user should usually be fully extended (if possible) at the bottom of the pedal circumference 210. For first time users, it is preferable to have the physical therapist/rehabilitation technician (PT) aid in helping to set the seat height 215. From there, calculations in leg length can be made and stored in the user's data profile 220. Once the manual adjustment is disabled 225, the user is free to begin exercising and letting the microprocessor/display unit 20, make the necessary adjustments for the user.

Figure 8:
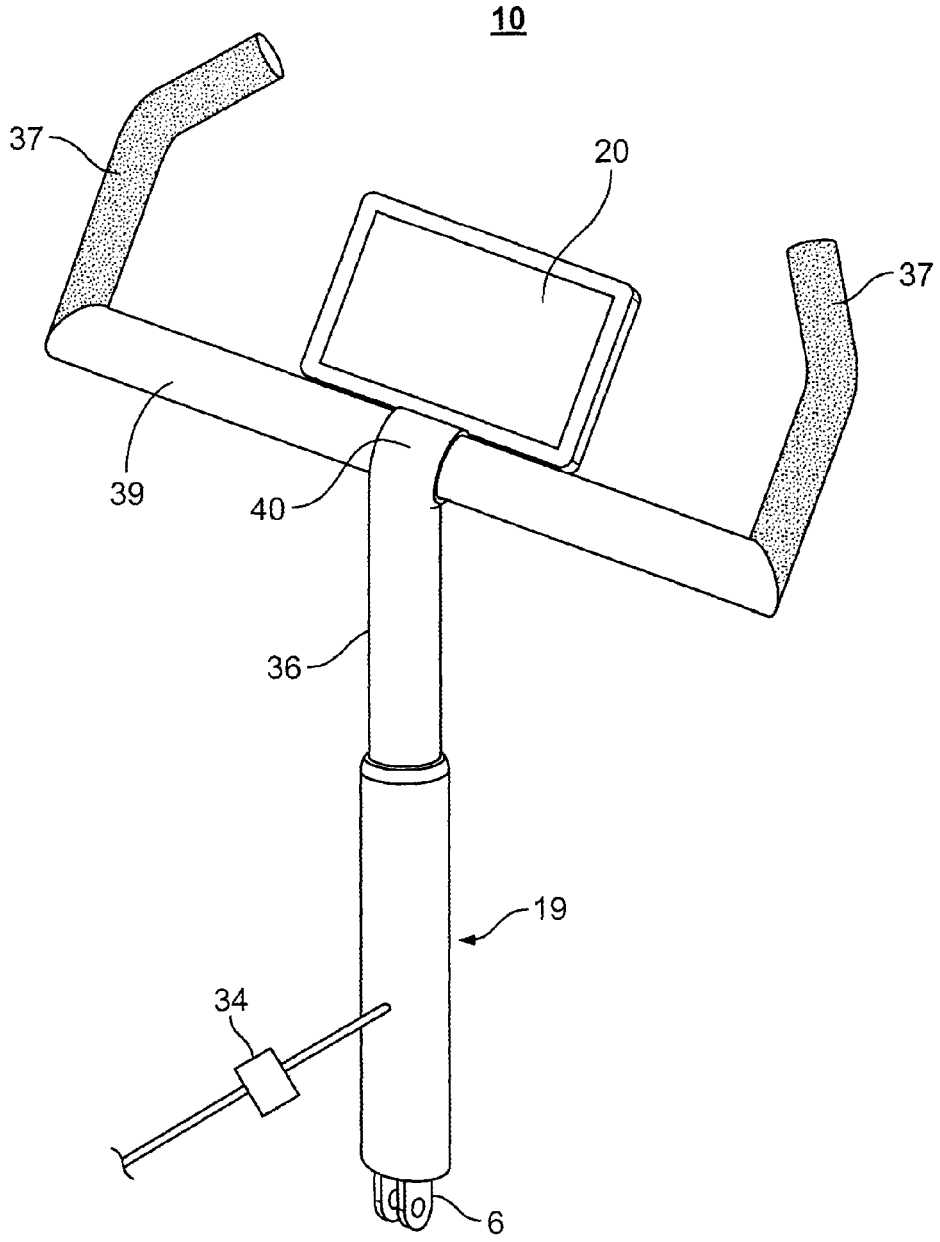
FIG. 8 is a perspective view of the handlebar assembly.

FIG. 8 is a perspective view of the handlebar assembly 10 of the rehabilitation device 1. The handlebar assembly 10 has two main features: a U-shaped bar 39 and a support 36. The support 36 fits within the top of the first vertical support 19 which is supported by the horizontal support 22. The support 36 is connected to an actuator 34 within the first vertical support 19. The actuator 34 is in turn operably connected to the motor/resistance unit 35. The terminal end of the support 36 has an adjustable coupling 40. This encircles the support 36 holding it securely in place, while still permitting the U-shaped bar 39 to rotate. The adjustable coupling 40 may be a solid extension of the support 36. Alternatively, there may be a thumb screw or other connection means that allow the adjustable coupling 40 to release the U-shaped bar 39. This gives the rehabilitation device 1 the option of having interchangeable handlebars 10. Additionally, the U-shaped bar has padding 37 to comfort and protect the user while on the rehabilitation device. The padding 37 can be any material of appropriate strength and durability such as a foam, rubber, silicone, or latex.

Figure 9:
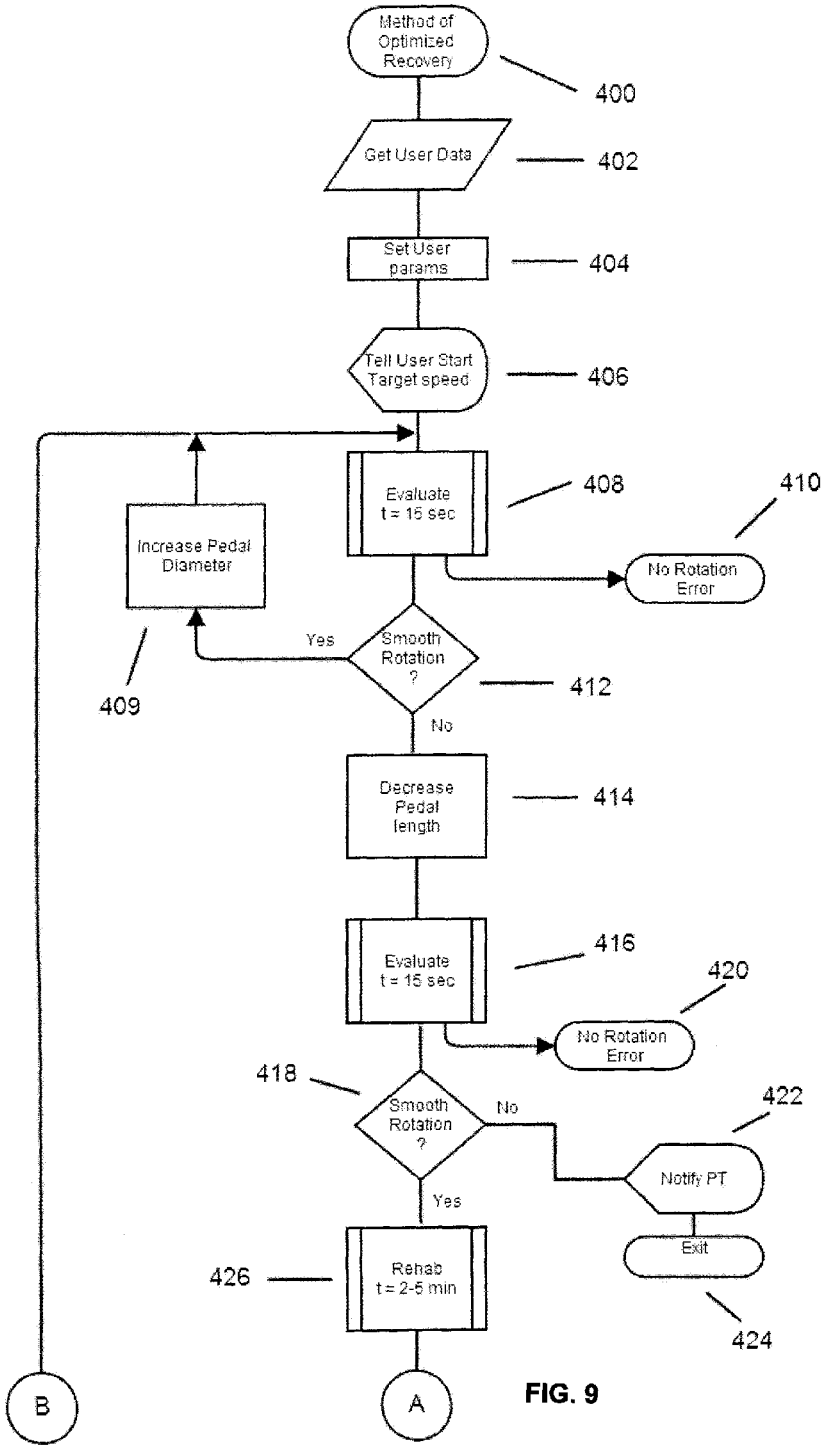
FIG. 9 is a flowchart illustrating a preferred method of optimizing a recovery process in accordance with the present invention.
Figure 9:
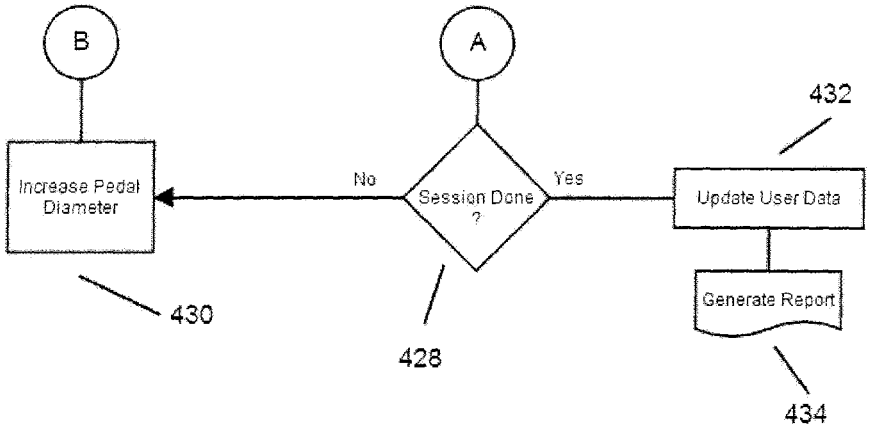

Referring to FIG. 9, there is a flowchart illustrating a high level view of the recovery process 400 using the above described rehabilitation device 1. Initially, the correct user data needs to be retrieved 402. This is done as previously described using identifiers such as passwords, names, birthdates, SSN, biometric identifiers, and the like. The user parameters are then set 404 into the rehabilitation device 1 by the microprocessor/display. The target speed is displayed on the screen. The user may then proceed with pedaling at a target pace 406 which may be measured in miles per hour (mph), kilometers per hour (kph), calories burned per hour, or rotations per minute (rpm). The on board microprocessor processes and compiles the data as the user pedals. The data is composed of varying technical aspects regarding the pedaling process such as torque and rotational speed. After the hardware has been configured, the system evaluates the patient's ability for a short time.

This evaluation time 408 is equal to about fifteen (15) seconds. This gives the rehabilitation device 1 the proper baseline to begin making necessary adjustments in real time. The user sits on the rehabilitation device 1 and begins to pedal. If the pedal rotation during this brief evaluation period is consistent and smooth 412, then the pedal diameter is increased slightly in accordance with the rehabilitation algorithm. This process of checking for a smooth and consistent rotation 412 and subsequently increasing in pedal diameter 409, repeats itself as the user's ability allows. When the patient or user can no longer rotate the pedals in a smooth and consistent manner, the diameter is reduced 414 and then the reduced setting is briefly evaluated to ensure that the patient can properly move the affected appendage for this optimized range of motion. Additionally, the derivatives of the rotation are checked by the microprocessor/display unit 20 to ensure correct operation and range of motion for the user. Assuming there continues to be a smooth and consistent rotation 418 and no rotation error is recorded 420, then the rehabilitation portion 426 of the workout can begin. The rehabilitation portion 426 of the workout is generally about five (5) minutes in length, but can range from about 2-10 minutes per rehabilitation session. In some instances, multiple rehabilitation sessions occur one after another until a predetermined time threshold has been reached. The user continues to pedal throughout the predetermined rehabilitation time. If, at the end of the first time cycle, the workout is not complete, the pedal circumference diameter is increased yet again 430 assuming the user's ability permits such an increase. The user is returned back to step 408 for brief evaluation to ensure the user will not be harmed using the increased pedal circumference. At the end of the predetermined rehabilitation time frame, and the session is completed 428, the user's data can be updated and stored 432 in the rehabilitation device 1. From there, the user, physical therapist/rehabilitation technician, tending nurse, or physician may generate a report to view the progress the user is making 434.

Assuming there is an inconsistent value to the measured factors, the rehabilitation device 1 will automatically decrease the circumference of the pedal throw 414. The user will then enter another evaluation period 416 of about fifteen (15) seconds. If the issues with the measured values are still not smooth 418 and there is no machine error 420, then the physical therapist/rehabilitation technician 422 should step in. Any further work may result in damage/injury to the user.

Figure 10:
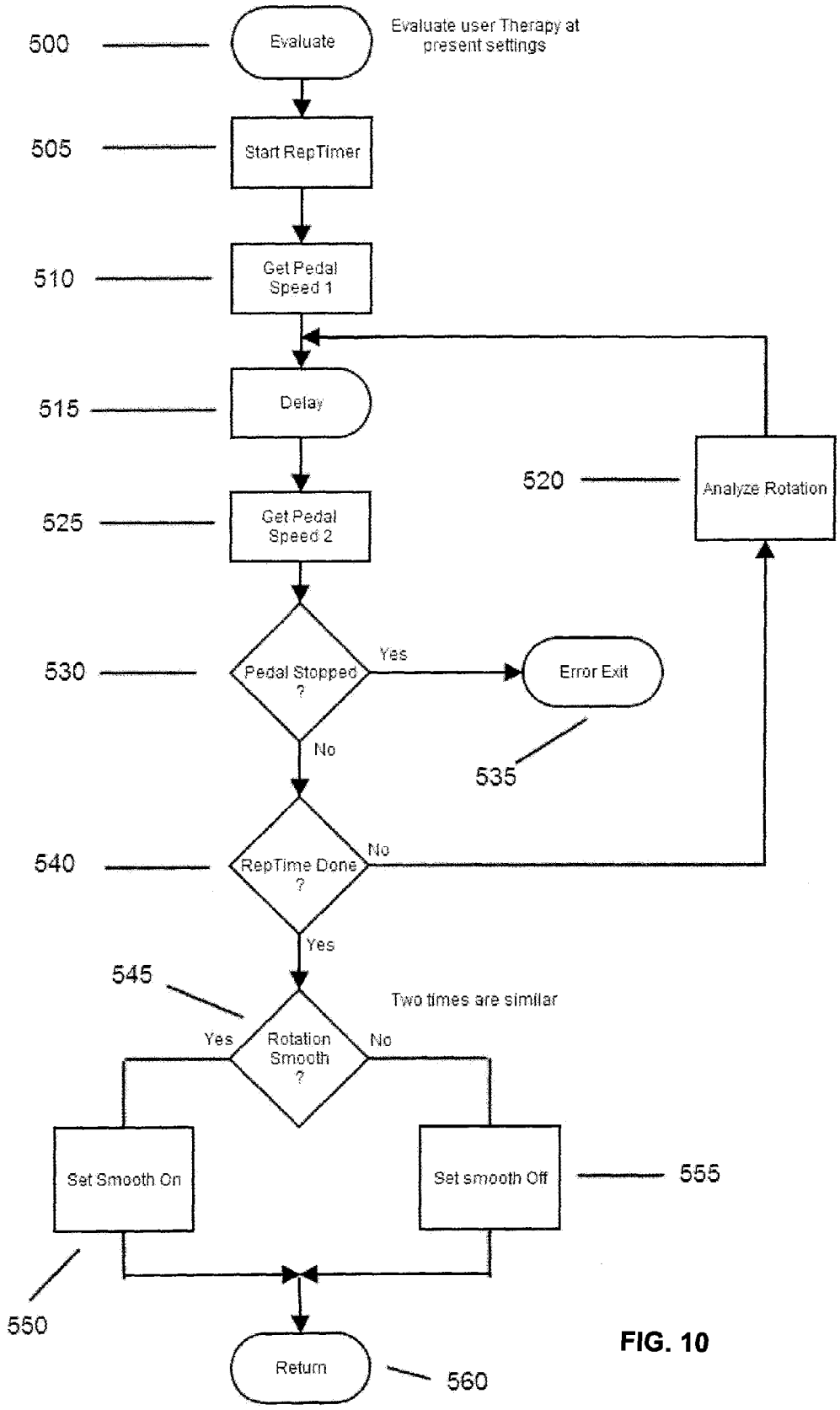
FIG. 10 is a flowchart illustrating the system logic for evaluating and adjusting the system parameters for a given user.

Referring to FIG. 10, there is a flowchart outlining the evaluation protocol the rehabilitation device 1 follows. To evaluate 500 a user at the present settings, the repetition timer is started 505. The rehabilitation device 1 will get a first pedal speed 510 and then wait, or delay 515, for a length of time. A second pedal speed 525 will be processed by the rehabilitation device 1 for comparison purposes. If the pedaling has stopped 530 before this second reading can take place the rehabilitation device 1 will exit 535 the program and alert the rehabilitation personnel of a problem. If the pedaling has continued the microcontroller will check to see if the repetition time has been completed 540. If not, the microcontroller will analyze the data for a smooth rotation 520 of the pedals. This process repeats until the timer end. When the timer ends, the device 1 will then set smooth rotation on 550 or off 555 depending on the analytical outcome. Once completed to satisfaction the user will be returned 560 to the calling program.

Figure 11:
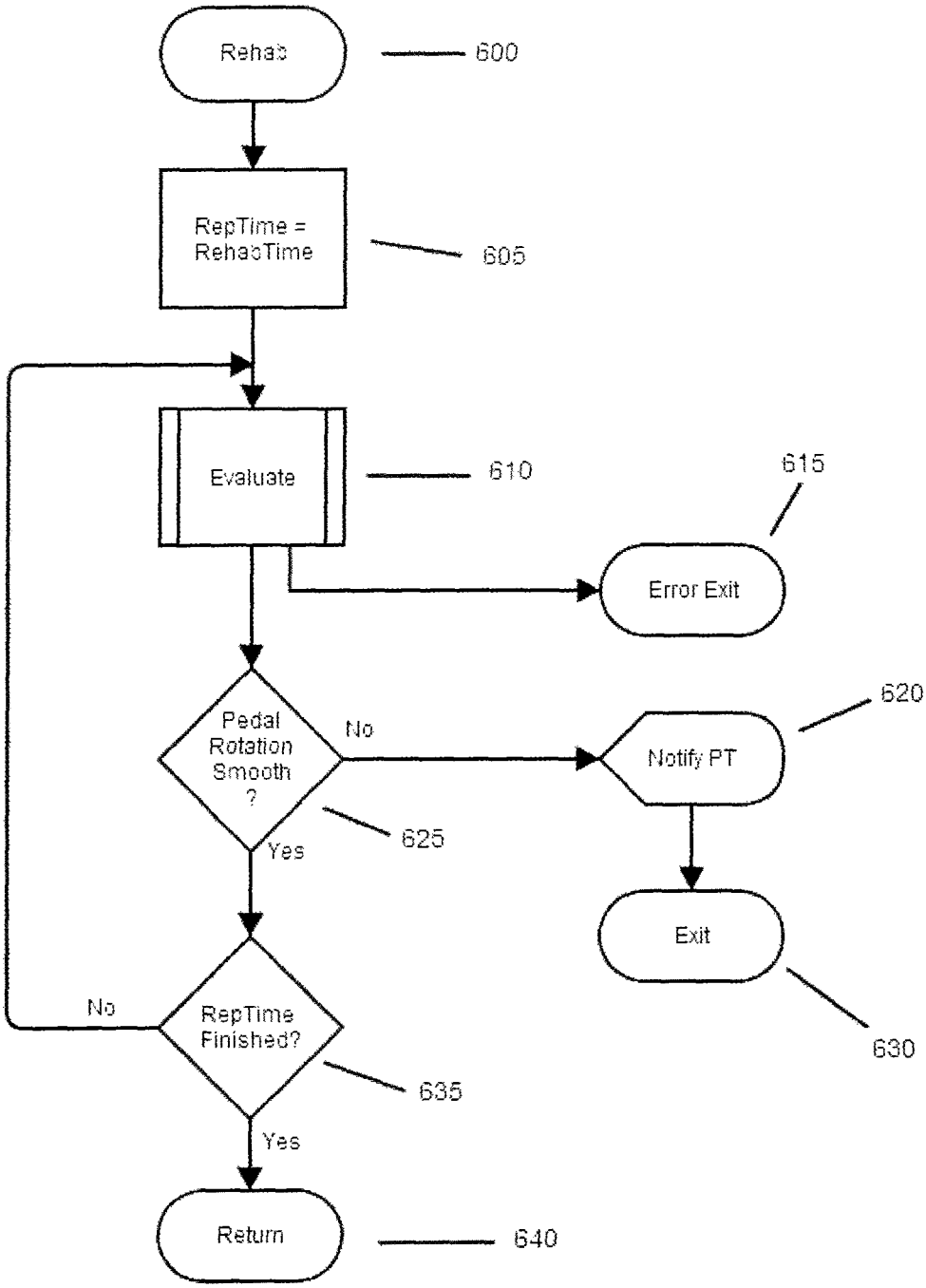
FIG. 11 is a flowchart illustrating one rehabilitation interval exhibiting static system settings during the rehabilitation process.

In FIG. 11, there is a flowchart illustrating the rehabilitation process for a rehabilitation device 1. The rehabilitation 600 begins with a repetition time being set to the rehabilitation time 605 of about 2-5 minutes. The user then begins to pedal and the rehabilitation device 1 evaluates 610 the user's performance. If the evaluate module detects no pedal rotation, an error 615 will be generated and the analysis exited. Otherwise, the pedal rotation is checked for a level of smoothness as described in FIG. 10. The purpose being that the smooth pedal rotation signifies that the user can comfortably and efficiently rotate the pedals. If the pedal rotation does not meet the standards for smoothness, then a notification will be sent to the physical therapist/rehabilitation technician (PT) 620. This could be a wireless alert such as a text message or email. Upon this notification, the rehabilitation device 1 will pause the rehabilitation process. If the pedal rotation is determined to meet the threshold for smoothness the rehabilitation device 1 will check to see if the rehabilitation time has been completed 635. If not, the process repeats until the rehabilitation timer ends at which time, control returns to FIG. 9. In FIG. 9, a determination is done to see if the session is complete. If so, the system exits. If not, pedal diameter is increases and new settings are evaluated. As the patient approaches full recovery, the system will observe that both legs are causing a similar resistance at the top of the pedal swing. This condition will be reported along with the final angle of flex that was achieved. It can then be determined if this level of flex is acceptable or further therapy is needed.

Additionally, the pedals 36 may not be the only item automatically adjusting during this process. The seat 12 and handlebars 10 of the rehabilitation device 1 can be adjusted to customize for people of varying shapes and sizes. It may be preferable to include these adjustments into the methodology described above. For example, the seat 12 will raise or lower in conjunction with the adjustment of the pedal throw.

The rehabilitation device 1 may take a number of forms known in the art and not explicitly shown here. Preferably, the rehabilitation device 1 is an upright bicycle. However, other iterations such as recumbent bicycles, spin bicycles, and mini exercise bicycles may employ some or all of the technology. For example, the control system and sensors can be applied to a "linear sled" type device that is typically used for rehabilitation after knee replacement. This device contains one or two sleds that the patient puts their feet in while lying in a prone position. The patient flexes the injured knee back and forth, while the foot rests in the sled. In this application, the control system monitors the extent of the motion and tracks the progress of increasing that extent.

While the focus has been placed on rehabilitation for lower body (hip, knee, etc.) joints, other iterations could permit rehabilitation of upper body joints such as arms and shoulders employing the same technology and methodologies. Additionally, the system and sensors may be retrofitted to existing systems to achieve the desired rehabilitation results. As described, initially the data is stored locally and will be transmitted to a central server unit as soon as possible. This server unit would comprise potentially all the data associated with the rehabilitation devices employing the described invention and allow for comparisons and modeling of the data on a large scale. It may also permit for "competition" against one another and results of particular workouts are viewed and/or posted.

Other features that the rehabilitation device 1 may have are straps to help secure the foot into the pedal 36. The pedals 36 may have a "clip in" structure for use with a special shoe adapted to lock into the pedal 36. This is preferential for users who have little to no use of their legs, as it would help to securely keep the feet firmly on the pedals 36. There may also be one or more places to hold a water bottle or similar drinking device to supply fluids to the patient before, during, and after the workout. This is not only a necessity but eliminates the need for the patient to stop a workout in order to get a drink of water.

What is claimed is:

1. A method of optimizing a recovery process using a rehabilitation device comprising:

initially setting a pedal diameter to the minimum value permitted by the rehabilitation device, wherein the pedal diameter may be set mechanically or manually, wherein the pedal diameter is determined by the distance between a crank axle and a pedal of a pedal assembly;

allowing a user to begin pedaling while a microprocessor monitors input values such as crank speed;

increasing the pedal diameter automatically in response to the microprocessor monitoring the input values;

reducing the pedal diameter automatically once the input values have reached a particular predetermined threshold;

increasing the pedal diameter automatically after a predetermined time of consistent sensor data from monitoring patient activity; and repeating the first increasing to second increasing steps until the preset time or number of cycles is achieved.

2. The method of claim 1 wherein consistency of the crank speed or consistency of the applied force is a determinative factor in the change in pedal diameter.

3. The method of claim 2 wherein an inconsistent crank speed results in a decrease in pedal diameter.

4. The method of claim 2 wherein a consistent crank speed or applied force for a predetermined timeframe results in a slight increase in pedal diameter.

5. The method of claim 2 further comprising the step of recording the input values in relation to time.

6. The method of claim 5 wherein the recorded values are stored on a storage medium.

7. The method of claim 1 wherein the correct relationship of seat to pedal diameter is maintained by automatically adjusting the seat height whenever the pedal circumferential distance is changed.

8. A rehabilitation device having automated, multi-positional elements comprising:

a frame with at least one cross bar and a base member, the frame having a first vertical support for a seat and an articulating second vertical support having a pivot joint and supporting a set of handlebars, a horizontal support attached to the first vertical support, and a pedal assembly;

a motor resistance unit coupled to the pedal assembly by a coupling mechanism;

wherein there are at least two actuators on the pedal assembly, the pedal assembly comprising a crank axle and an upper and lower crank arm extending from each end of the crank axle wherein the at least two actuators are on each of the crank arms thereby altering the circumferential diameter of the pedal assembly; and wherein there may be a plurality of linear actuators for eliciting movement of the seat and the second vertical support.

9. The rehabilitation device of claim 8 wherein the actuator connected to the second vertical support enables back and forth movement of the second vertical support relative to the first vertical support.

10. The rehabilitation device of claim 8 wherein the motor resistance unit provides variable resistance or rotational power to the pedal assembly.

11. The rehabilitation device of claim 8 further comprising a microprocessor/display unit having a touchscreen and having the ability to adjust various settings associated with the rehabilitation device, wherein the microprocessor/display unit streams data to a central data server and enables remote monitoring of the data and manipulation of the device settings.

12. The rehabilitation device of claim 8 wherein the plurality of actuators permits automated height adjustment of the seat and handlebars.

13. The rehabilitation device of claim 8 further comprising a plurality of sensors and a microprocessor wherein the plurality of sensors monitor factors such as torque and rotational speed.

14. The rehabilitation device of claim 8 wherein the microprocessor records the initial and final parameters for each session creating a viewable database of user parameters and settings, wherein the viewable database is accessible and downloadable through a central data server enabling a patient to use any rehabilitation device at any location.

15. The rehabilitation device of claim 14 wherein the database includes at least the initial and final angle of flex, the rate of improvement, derivative of improvement, duration of session, and number of repetitions.

16. The rehabilitation device of claim 15 wherein the data may be electronically transmitted to a third party via wired or wireless methods.

17. The rehabilitation device of claim 16 wherein the data is transmitted in a HIPAA compliant format.

18. The rehabilitation device of claim 10 wherein the motor resistance unit automatically increases or decreases the resistance through the pedal assembly in response to the user's ability.

19. The rehabilitation device of claim 9 wherein the position of the second vertical support dictates the user's hip angle resulting in a change in the forces on the hip and knee joints of a user.

20. The rehabilitation device of claim 8 wherein the pedal assembly can simultaneously have a different circumferential diameter for each pedal.

21. A portable rehabilitation device comprising:

a motor resistance unit having a housing;

a plurality of sensors and a microprocessor contained within the housing;

a pedal assembly operably connected to the motor resistance unit, wherein the motor resistance unit automatically adjusts the rotational speed or simulated resistance, wherein the pedal assembly comprises a crank axle and an upper and a lower crank arm extending from each end of the crank axle wherein the at least two actuators are on each of the crank arms thereby altering the circumferential diameter of the pedal assembly; and a coupling mechanism that operably connects the pedal assembly to the motor resistance unit.

22. The portable rehabilitation device of claim 21 wherein the analysis, control and reporting capabilities are the same as those of the rehabilitation device described herein.

23. The portable rehabilitation device of claim 21 wherein the control system permits and communicates data in real time to a remote professional and permits the remote professional to modify the parameters of the unit in real time.

24. The portable rehabilitation device of claim 22 wherein the microprocessor/display unit contains pre-programmed algorithms for device adjustments.

25. The portable rehabilitation device of claim 20 wherein pedal assembly is capable of having two different circumferential diameters.

26. A rehabilitation device that provides an autonomous rehabilitation process of increasing the range of motion on a localized area of the human body by systematically extending and flexing the localized area through the range of motion by analyzing sensory data and making mechanical adjustments based on the sensory data in real time.

27. The rehabilitation device of claim 26 wherein the rehabilitation device further autonomously provides resistance to promote muscle strength and toning.

28. The rehabilitation device of claim 26 wherein the rehabilitation device automatically alters the rehabilitation protocol to promote building muscle tissue and overall strength rather than increasing an individual's range of motion once the range of motion has reached acceptable levels.

29. The rehabilitation device of claim 28 wherein the acceptable levels for the range of motion can vary from about 0° to about 140°.

30. The rehabilitation device of claim 28 wherein the increase in muscle tissue and overall strength is facilitated by stepwise increase the external force applied by the rehabilitation device in real time.

31. A method of evaluating a range of motion in an individual's knee joint employing the rehabilitation device of claim 8 comprising:

setting a pedal diameter to the minimum allowable diameter;

allowing the individual to begin pedaling while a microprocessor monitors at least crank speed and consistency;

increasing the pedal diameter incrementally until the microprocessor records an inconsistent crank speed or consistency;

calculating the maximum range of motion based on at least the inconsistent crank speed or consistency, seat height, and length of the individual's leg; and storing the calculated maximum range of motion on a computer readable storage medium.

* * * * *